US008978771B2

(12) United States Patent
Palomba et al.

(10) Patent No.: US 8,978,771 B2
(45) Date of Patent: Mar. 17, 2015

(54) SUBSEA MACHINE AND METHODS FOR SEPARATING COMPONENTS OF A MATERIAL STREAM

(75) Inventors: Sergio Palomba, Florence (IT); Simone Billi, Florence (IT); Fabrizio Mammoliti, Civitavecchia (IT); Andrea Masi, Florence (IT); Alessandro Pagliantini, Siena (IT)

(73) Assignee: Nuovo Pignone S.p.A., Florence (IT)

( * ) Notice: Subject to any disclaimer, the term of this patent is extended or adjusted under 35 U.S.C. 154(b) by 737 days.

(21) Appl. No.: 13/192,176

(22) Filed: Jul. 27, 2011

(65) Prior Publication Data

US 2012/0024534 A1 Feb. 2, 2012

(30) Foreign Application Priority Data

Jul. 30, 2010 (IT) ..... CO2010A0041

(51) Int. Cl.
*E21B 7/12* (2006.01)
*E21B 43/01* (2006.01)

(52) U.S. Cl.
CPC ..... *E21B 43/0107* (2013.01)
USPC ..... 166/345; 166/351; 166/357; 166/75.12

(58) Field of Classification Search
CPC ..... E21B 21/06; E21B 21/063; E21B 21/067; E21B 43/34; E21B 43/38; E21B 43/385
USPC ..... 166/345, 351, 357, 75.12; 175/206
See application file for complete search history.

(56) References Cited

U.S. PATENT DOCUMENTS

| | | | | | |
|---|---|---|---|---|---|
| 1,948,890 | A | * | 2/1934 | Sims et al. | 208/105 |
| 1,949,630 | A | * | 3/1934 | Asbury et al. | 208/57 |
| 1,957,320 | A | * | 5/1934 | Coberly et al. | 166/369 |
| 1,958,010 | A | * | 5/1934 | Meurk | 210/110 |
| 2,644,401 | A | * | 7/1953 | Ragland | 417/344 |
| 3,630,638 | A | * | 12/1971 | Huso | 417/3 |
| 4,505,333 | A | | 3/1985 | Ricks, Sr. | |
| 4,982,794 | A | * | 1/1991 | Houot | 166/357 |

(Continued)

FOREIGN PATENT DOCUMENTS

| | | |
|---|---|---|
| EP | 0568742 A1 | 11/1993 |
| EP | 1593418 A1 | 11/2005 |

(Continued)

OTHER PUBLICATIONS

Italian Search Report and Written Opinion issued in connection with IT Application No. ITCO201000041, Feb. 9, 2011.

*Primary Examiner* — Matthew Buck
*Assistant Examiner* — Aaron Lembo
(74) *Attorney, Agent, or Firm* — GE Global Patent Operation

(57) ABSTRACT

Systems and methods include using a subsea machine for separating a mixture received from a seabed well. The subsea machine includes: a chamber configured to receive and separate by gravity the mixture received from the seabed well. The chamber includes: a housing configured to contain the mixture received from the undersea well during separation, and a piston provided inside the housing and separating the housing into a top section and a bottom section. The piston is configured to move in a first direction along an axis to create more space in the top section for receiving the mixture from the seabed well and to move in a second opposite direction along the axis for removing the mixture from the chamber after separation has occurred.

14 Claims, 7 Drawing Sheets

(56) References Cited

U.S. PATENT DOCUMENTS

| | | | | |
|---|---|---|---|---|
| 5,073,090 | A * | 12/1991 | Cassidy | 417/102 |
| 5,382,141 | A * | 1/1995 | Stinessen | 417/423.8 |
| 5,580,463 | A * | 12/1996 | Hubred | 210/703 |
| 6,138,774 | A * | 10/2000 | Bourgoyne et al. | 175/7 |
| 6,364,940 | B1 * | 4/2002 | Prueter et al. | 95/261 |
| 6,578,637 | B1 * | 6/2003 | Maus et al. | 166/350 |
| 6,881,329 | B2 | 4/2005 | Amado et al. | |
| 7,011,152 | B2 * | 3/2006 | Soelvik | 166/65.1 |
| 7,503,385 | B2 * | 3/2009 | Tips et al. | 166/72 |
| 7,963,335 | B2 * | 6/2011 | Krehbiel et al. | 166/335 |
| 2011/0155385 | A1 * | 6/2011 | Haheim | 166/357 |

FOREIGN PATENT DOCUMENTS

| | | | |
|---|---|---|---|
| GB | 1106264 | A | 3/1968 |
| WO | 90/08897 | A1 | 8/1990 |
| WO | 02063135 | A1 | 8/2002 |

* cited by examiner

SUBSEA MACHINE AND METHODS FOR SEPARATING COMPONENTS OF A MATERIAL STREAM

TECHNICAL FIELD

The embodiments of the subject matter disclosed herein generally relate to separating a stream of a medium into components and more particularly to separating a stream from an undersea wellhead and compressing a gas component of the stream.

BACKGROUND

Oil and natural gas are used in many parts of our society today. For example, oil is the basis for fueling a large portion of today's transportation, as well as being a component in many fields of product manufacture, e.g., plastics manufacturing, and natural gas can be used both as a heating source and as a source to meet other energy needs. As our society has consumed vast quantities of oil and natural gas over time, the more accessible supplies of these hydrocarbons have been diminished causing the search for more oil and natural gas to expand to more challenging environments. One such challenging environment is an undersea environment.

Currently, at some depths, it is possible to extract oil and gas from an undersea well. An overview of this process is shown in FIG. 1. FIG. 1 shows a seabed well 102 from which a stream of a mixture flows to a separator 104. This mixture can include oil, gas, mud, water and other materials flowing from the seabed well 102 which are physically mixed together. The separator 104 separates the mixture into various components, e.g., gas and other materials. The gas is then transferred to a compressor 106 which compresses the gas and sends the gas along to various facilities 108, e.g., a storage facility.

Many different types of separators 104 currently exist for use in separating out components of a stream. One example of a separator 104 is a centrifugal separator 104 as shown in FIG. 2. Initially, a gas/liquid stream 202 enters the centrifugal separator 104. The gas/liquid stream 202 moves past a swirl element 204 and into a separation chamber 206 which then leads to gas extraction 208. The result of this process is two separate streams, a liquid free gas stream 210 and a separated liquid stream 212. Other types of separators 104 include baffle separators, electrostatic coalescers and magnetic separators.

As previously described, the undersea environment is a challenging environment for obtaining oil and gas. Additionally, manufacturing equipment to safely and efficiently operate in a cost effective manner in such an environment will be an ongoing challenge. Accordingly, systems and methods for improving undersea oil operations are desirable.

SUMMARY

According to an exemplary embodiment there is a subsea machine for separating a mixture received from a seabed well. The subsea machine includes: a chamber configured to receive and separate by gravity the mixture received from the seabed well. The chamber includes: a housing configured to contain the mixture received from the undersea well during separation, and a piston provided inside the housing and separating the housing into atop section and a bottom section. The piston is configured to move in a first direction along an axis to create more space in the top section for receiving the mixture from the seabed well and to move in a second opposite direction along the axis for removing the mixture from the chamber after separation has occurred. The subsea machine also includes: a compressor section fluidly connected to the top section, the compressor section being configured to receive, compress and propel the gas towards an onshore facilities.

According to another exemplary embodiment there is a method for separating a mixture received from a seabed well in a subsea machine. The method includes: receiving and separating the mixture received from the seabed well in a chamber; containing the mixture received from the seabed well during separation in a housing; moving a piston in a first direction along an axis to create more space in the chamber for receiving the mixture and moving the piston in a second opposite direction along the axis for removing the mixture from the chamber after separation has occurred; receiving and compressing the gas at the compressor section; and propelling the compressed gas towards an onshore facilities.

According to another exemplary embodiment there is a subsea machine for separating a mixture received from a seabed well. The subsea machine includes: a chamber configured to receive the mixture from the seabed well and to eject the mixture by means of the pressure of sea water inside the chamber.

BRIEF DESCRIPTION OF THE DRAWINGS

The accompanying drawings illustrate exemplary embodiments, wherein.

DETAILED DESCRIPTION

The following detailed description of the exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "one embodiment" or "an embodiment" means that a particular feature, structure, or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 1:
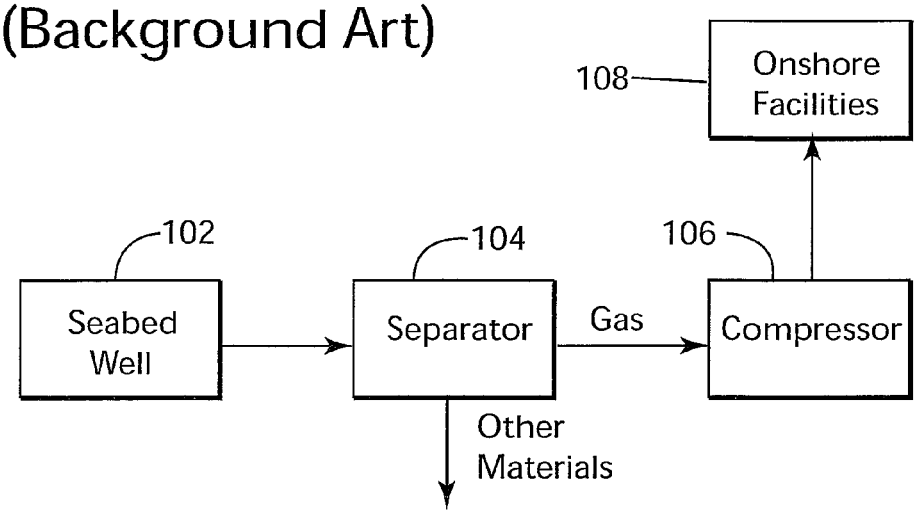
Fig. 1 (Background Art)
FIG. 1 depicts equipment used in a flow of a mixture from a seabed well to onshore facilities.
Figure 2:
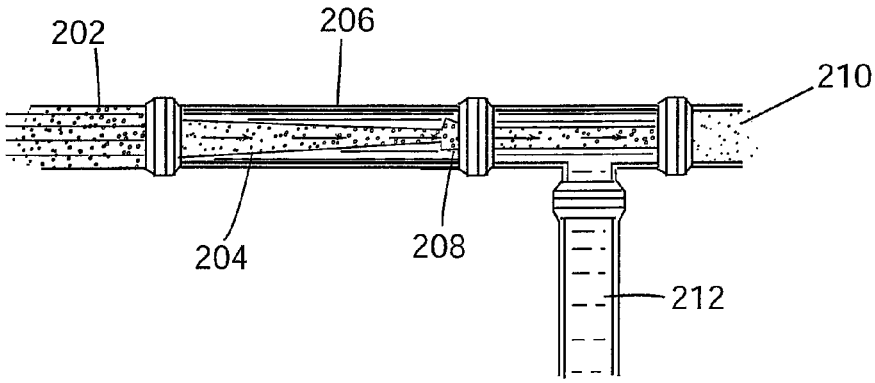
Fig. 2 (Background Art)
FIG. 2 shows a centrifugal separator.
Figure 3:
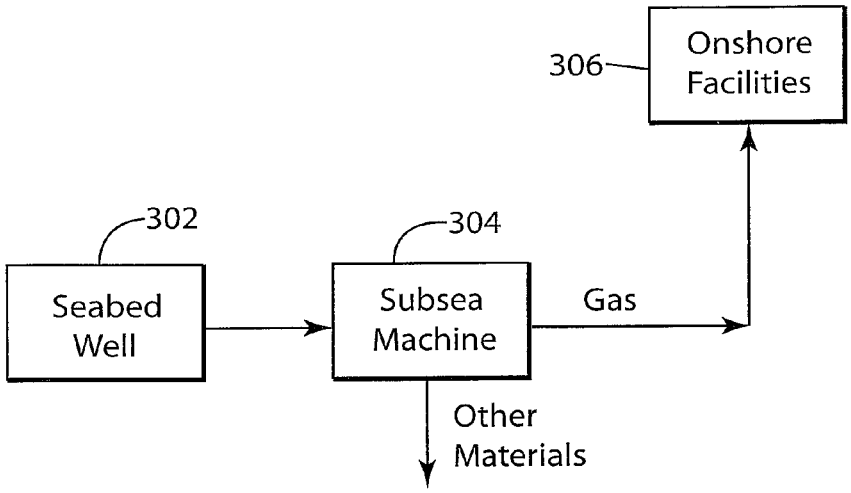
FIG. 3 shows equipment used in a flow of the mixture from a seabed well to onshore facilities according to exemplary embodiments.
Figure 4:
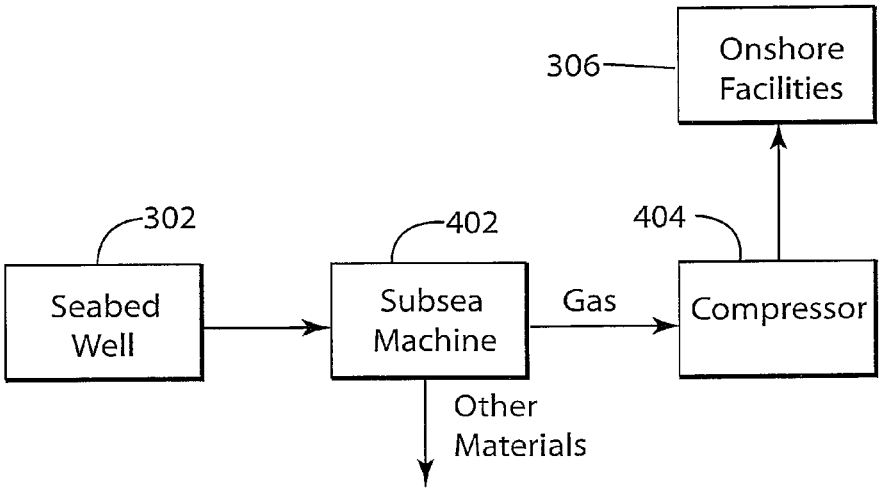
FIG. 4 illustrates an alternative equipment option used in a flow of the mixture from the seabed well to onshore facilities according to exemplary embodiments.

As described in the Background section, obtaining oil and/or gas from a seabed well in an undersea environment is challenging. According to exemplary embodiments, there are exemplary components for delivering the gas component from an undersea well as shown in FIG. 3. FIG. 3 shows a seabed well 302 from which a mixture, which can include oil, gas, mud, water and other materials or substances which are physically mixed together, flows to a subsea machine 304. The subsea machine 304 can be located on the sea floor relatively close to the seabed well 302. The subsea machine 304 separates the gas out from the other components of the mixture, compresses the gas and sends the gas onwards to onshore facilities 306. In one application, the separation takes place by gravity only, i.e., no machine or device is used to actively perform the separation. In this application, the separation is achieved by simply allowing the mixture to separate itself under the influence of gravity (due to the fact that the gas, fluid and mud in the mixture have different densities). According to an alternative exemplary embodiment, the separator and compressor functions can be separated as shown in FIG. 4, which includes the seabed well 302, a subsea machine 402 (which performs separation of the stream from the seabed well 302), a compressor 404 and the onshore facilities 306.

Figure 5:
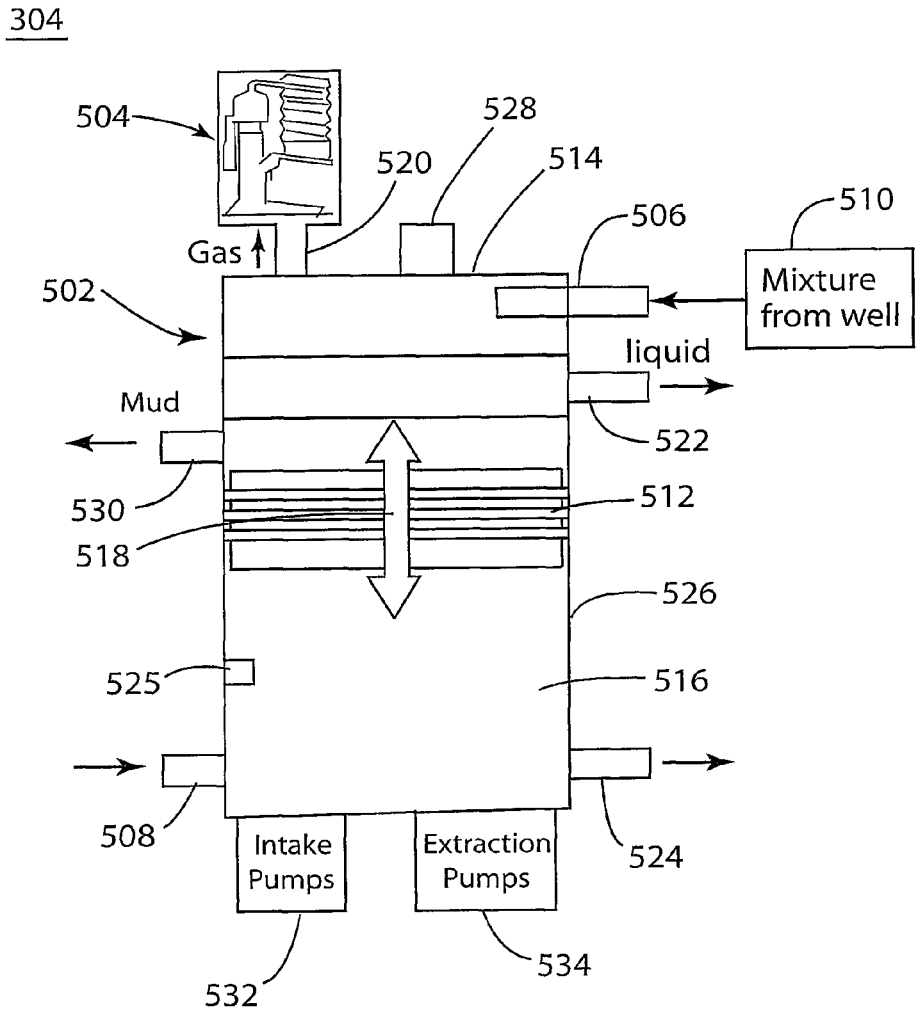
FIG. 5 shows a subsea machine according to exemplary embodiments.

According to exemplary embodiments, the subsea machine 304 can be used to separate the mixture into various component, e.g., a gas component, a liquid component and a mud component. An exemplary subsea machine 304 is shown in FIG. 5 and will now be described. The subsea machine 304 includes a chamber 502 for receiving and separating the mixture from the seabed well 302, and a compressor section 504 for compressing a gas component of the received mixture. The chamber 502 can have a height in a range of 5-10 meters, however, according to other exemplary embodiments, other heights can be used. The chamber 502 includes a mixture intake section 506 which receives the mixture from the well 510 and a seawater intake section 508 which receives seawater. The received seawater is under a pressure which is related to the depth of the seawater intake section 508 from the surface of a body of water, e.g., an ocean, in which the subsea machine 304 is located. This seawater pressure allows for a constant pressure to be maintained inside the chamber 502 when desired.

According to exemplary embodiments, the chamber 502 has a housing 526 which contains a top section 514, a bottom section 516 and a piston 512 which separates the two sections and which can be moved up or down along an axis (as shown by the double headed arrow 518). The diameter of the piston 512 can be in a range of a few meters (e.g., 1 to 10 meters), and/or scaled depending upon the height of the chamber 502.

The chamber 502 can separate the received mixture from the well 510 by having the mixture enter the top section 514 of the chamber 502. This material inflow is under a pressure, e.g., the pressure of the well, and applies a pressure on the piston 512 which forces the piston 512 to move towards the bottom of the chamber 502. Once the top section 514 is at its desired capacity, the inflow of the mixture is stopped. For example, a positive stop 525 may be added to stop a movement of the piston 512. Other devices may be used to achieve the same result. The mixture is then separated out over time, e.g., hours, by gravity, i.e., the gas goes to the top of the top section 514, the solids go to the bottom of the top section 514 and the liquid ends up between the gas and the solids. According to exemplary embodiments, sound and vibration can be introduced into the chamber 502 to accelerate the separation process, thereby shortening the separation cycle time, as shown by the optional sound/vibration module 528. Additionally, pre-compression of the mixture from well 510 can be performed to aid in separating out the wet content from the stream.

According to exemplary embodiments, the subsea machine 304 also has four exits. A gas extraction exit 520 is located at the top of the chamber 502 and connects the chamber 502 to the compressor section 504. Additionally, when appropriate, the gas extraction exit 520 allows for the passage of the gas from the top section 514 to the compressor section 504. A liquid extraction exit 522 allows for the removal of liquid from the top section 514 after separation occurs. A mud extraction exit 530 allows for the removal of mud (and other solids/semi-solids) from the top section 514 after separation occurs. The removal of the gas, liquid and mud is achieved by moving piston 512 in an upward direction. Thus, in one application, the exits are so disposed to correspond to only a component (gas, liquid, mud, etc.) for a given volume of the top section 514. The bottom section 516 is used to contain seawater for moving the piston 512 in an upward direction when desired. Additionally, the bottom section 516 includes a seawater extraction exit 524 for removal of the seawater when it is desired for the piston 512 to be moved in a downward direction.

Once the mixture has separated, the piston 512 can be moved in an upward direction. This occurs by allowing seawater to enter through the seawater intake 508. The seawater is under a pressure related to water depth, and this pressure is exerted on the bottom of the piston 512. Since this applied water pressure is greater than the pressure applied by the mixture in the top section 514, the piston 512 moves in an upward direction which forces the various separated mixture components, e.g., mud, liquids and gas, to exit the top section 514 through their respective extraction exits.

Additionally, if desired, other mechanical means can be introduced to assist in moving the piston 512. The upward motion of piston 512 can be limited by controlling the seawater intake. Also, if extra head compression is needed, a pumping system can be introduced in the seawater intake 508. The various arrows which are not numbered and shown in FIG. 5 show the directional flow of the various streams and components described above.

According to other exemplary embodiments, various combinations of valves and pumps can be put in-line in various areas to assist in the above described exemplary embodiments. For examples, valves can be put into place to only allow the entrance and exit of any of the streams described above when desired, i.e., valves can be put in place for each exit/entrance into the chamber 502. Additionally, according to other exemplary embodiments, pumps can be added to assist in the movement of any of the streams to either facilitate the removal of a stream, e.g., mud, liquid and gas, and/or to assist in the motion of the piston 512. No pump may be necessary if seawater intake 508 is closed by a valve and thus, it is possible to use the pressure of the mixture from the well to move the piston down and extract the water (depending to the downstream pressure). However, according to other exemplary embodiments, a pump can be used to facilitate the water extraction itself. The various intake and extraction pumps are generically shown as intake pumps 532 and extraction pumps 534 in FIG. 5 (while the pumps 532 and 534 are shown attached to the bottom of the chamber 502, they can be located in other positions as desired, e.g., in-line with an exit or intake).

According to exemplary embodiments, the compressor 504 is a centrifugal compressor, however according to alternative exemplary embodiments, other types of compressors can be used. Additionally, according to exemplary embodiments, while shown as a single subsea machine 304 in FIG. 5, the separation chamber 502 and the compressor 504 can be separate units as shown in FIG. 4.

Figure 6:
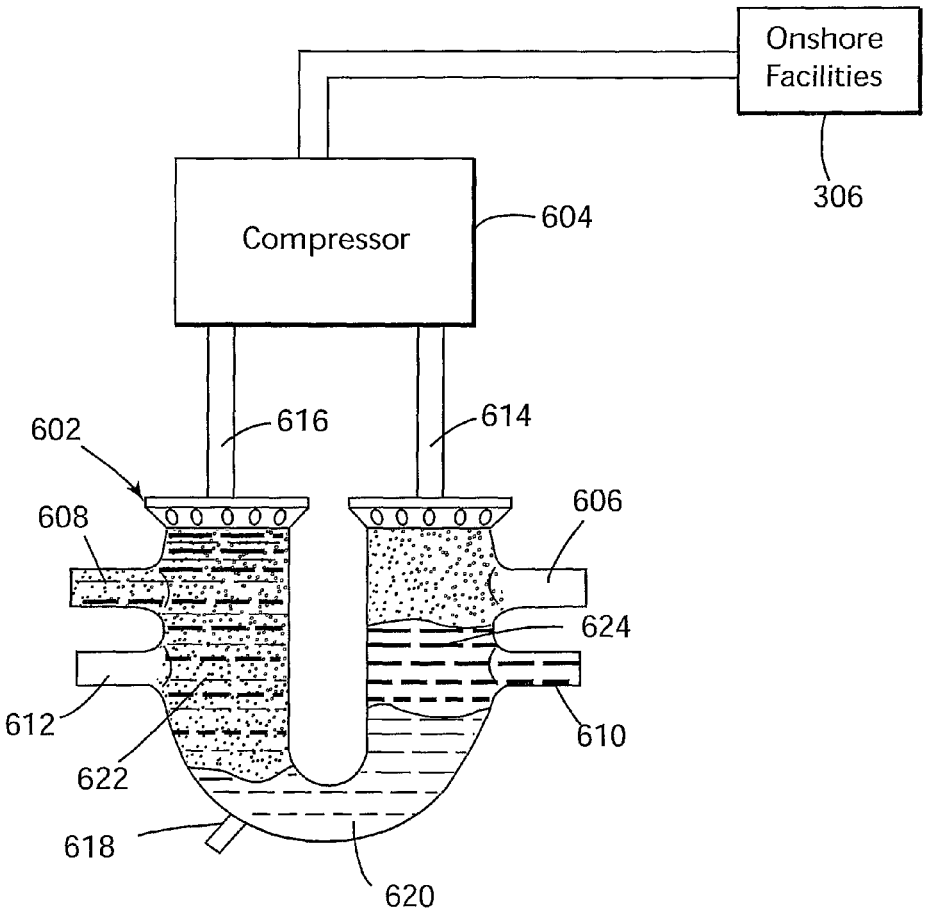
FIG. 6 shows a U-shaped pipe tower, a compressor and the onshore facilities according to exemplary embodiments.

According to another exemplary embodiment, a different style of subsea machine can be used for separation of the mixture as shown by a U-shaped pipe tower 602 shown in FIG. 6. The U-shaped pipe tower 602 can receive the mixture from the seabed well 302 from either intake 606 and 608. Seawater enters, when desired, through a seawater intake 618, however other liquids/materials could be used. The seawater acts as a barrier between the two column portions of the U-shaped pipe tower 602. Upon separation, oil exits via either oil extraction exit 610 or 612 and gas exits via either gas extraction exit 614 or 616. The gas is then compressed by the compressor 604 and sent on to an onshore facility 306. The muds/solids may be removed together with the liquid. However, according to other exemplary embodiments, another exit could be provided for the mud/solid. Additionally, the compressor 604 can either be a part of the U-shaped pipe tower 602, or a separate piece of equipment.

In operation, the U-shaped pipe tower 602 begins with an amount of seawater (or other liquid/material) in the bottom section 620 of the pipe. Intakes/extraction exits 610, 612, 614 and 616 are closed. Intake 606 and intake 608 are open which allows material, e.g., oil/gas and other substances mixture, to enter a first vertical section 622 and a second vertical section 624 of the U-shaped pipe tower 602. When a desired amount of material has entered the U-shaped pipe tower 602, intakes 606 and 608 are closed. After enough time, e.g., hours, has passed for separation to occur, intake 608 is opened to allow more well mixture to enter the vertical section 622. This is the exemplary configuration as shown in FIG. 6. Extraction exits 614 and 610 are then opened to allow for the exiting of the gas and oil based on the force exerted by the well mixture entering through intake 608 to the seawater which is then applied to the oil section and gas section, respectively. When the gas and oil have been extracted, intake 608 is closed allowing for the process cycle to begin anew (on the other side of the U-shaped pipe tower 602).

Figure 7:
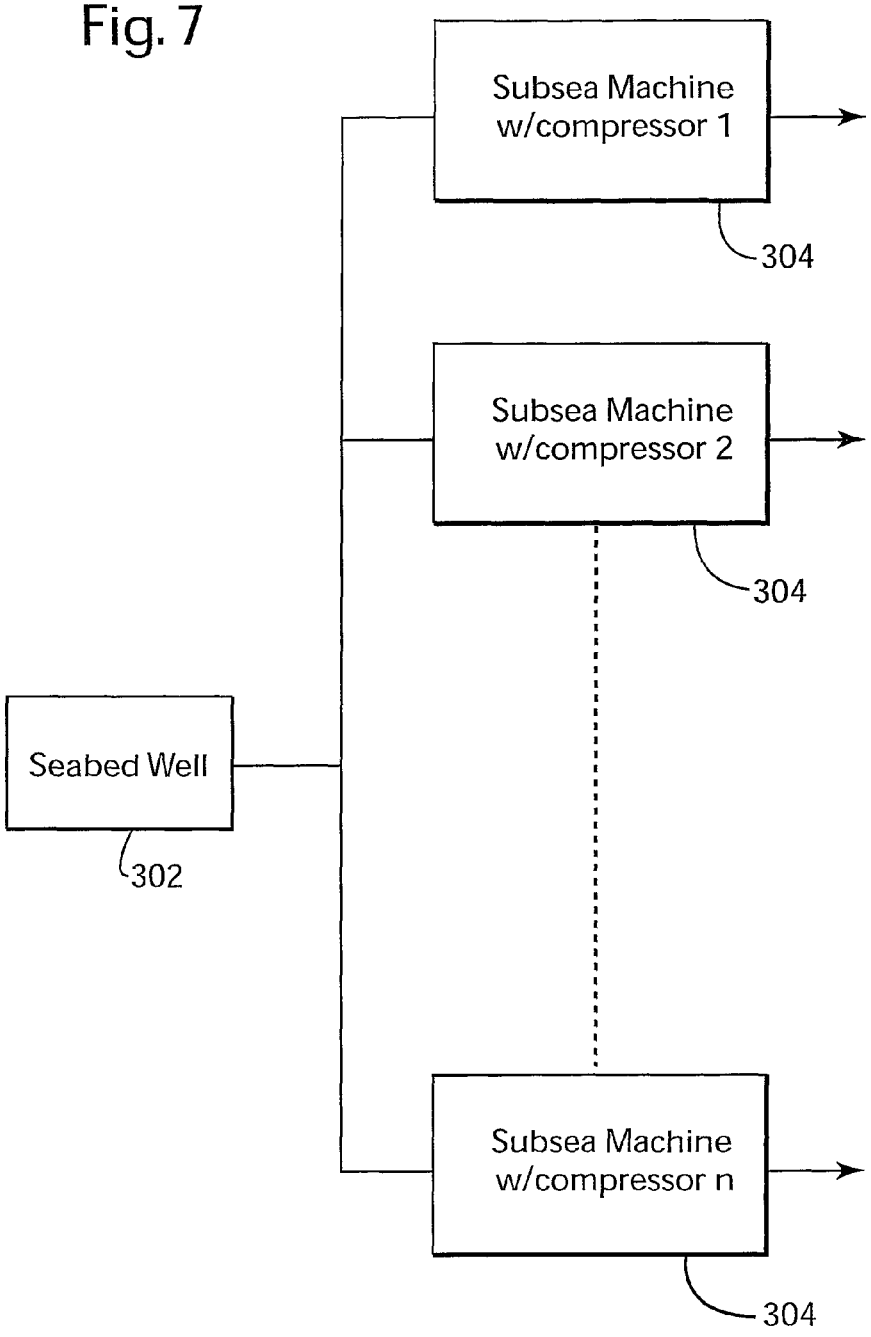
FIG. 7 illustrates an array of subsea machines which receive a mixture from the seabed well according to exemplary embodiments.
Figure 8:
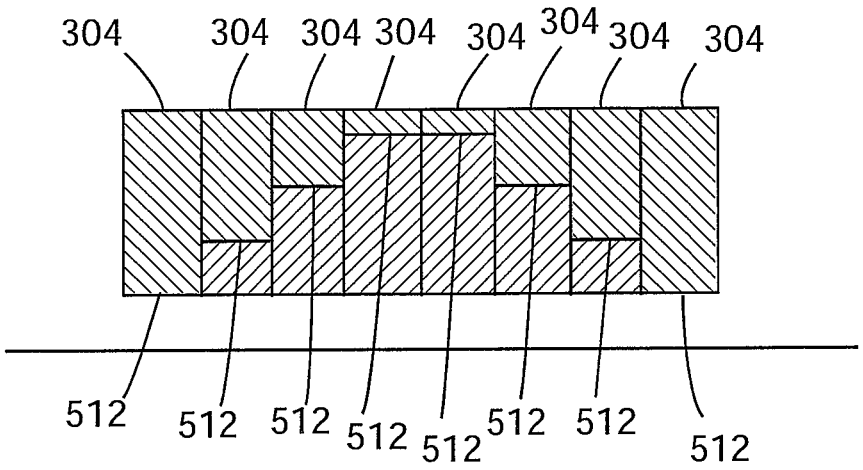
FIG. 8 depicts having the array of subsea machines operating at different parts of a separation cycle according to exemplary embodiments.

According to exemplary embodiments, the seabed well 302 can supply a plurality of subsea machines 304 (or U-shaped pipe towers 602 with associated compressors 604) as shown in FIG. 7. This ability to have a variable number of subsea machines allows for a continuous flow of separated material to be sent towards the onshore facility 306 (shown in FIG. 3). Additionally, it allows for modularization as desired. According to an exemplary embodiment, 10-15 units could be in an array to support the output of the single seabed well 302. An example of an array of eight subsea machines is shown in FIG. 8, in which the relative piston 512 positions for each subsea machines 304 are shown. According to exemplary embodiments, the pistons 512, in six of the subsea machines 304, have started to move up or down, while in two of the subsea machines 304 (the leftmost and the rightmost subsea machines 304) the piston 512 is at its lowest position indicating separation is still occurring, thus ensuring an overall continuous output towards the onshore facility 306. Additionally, while the configuration is shown as the U-shaped pipe tower 602, other configurations could be used, depending upon particular requirements, to create a similar process.

Figure 9:
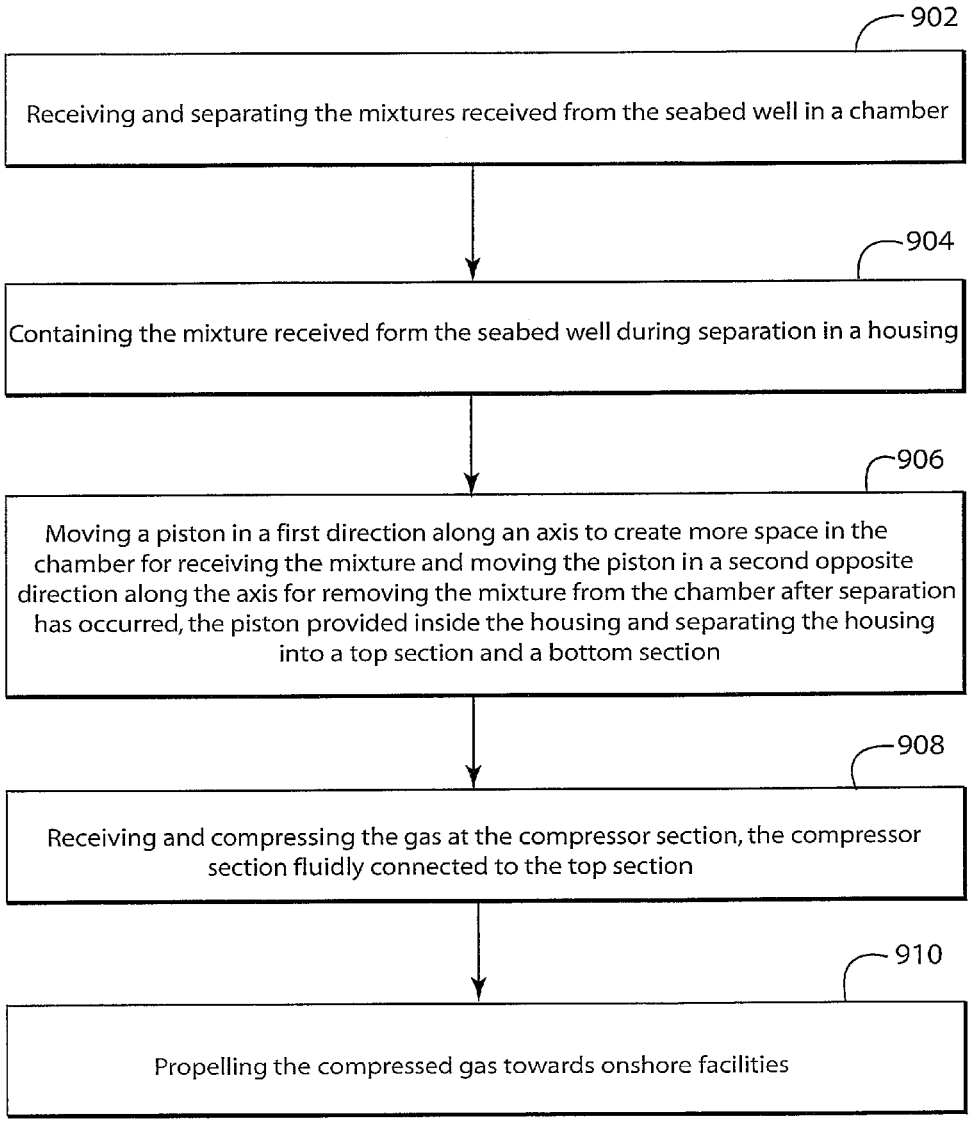
FIG. 9 shows a flowchart for a method of separating the mixture received from a seabed well in the subsea machine according to exemplary embodiments.

According to exemplary embodiments, there is a method for separating a mixture received from the seabed well 302 in the subsea machine 304 as shown in the flowchart of FIG. 9. The method includes: a step 902 of receiving and separating the mixture received from the seabed well in a chamber; a step 904 of containing the mixture received from the seabed well during separation in a housing; a step 906 of moving a piston in a first direction along an axis at least by means of the mixture pressure from the well to create more space in the chamber for receiving the mixture and moving the piston in a second opposite direction along the axis at least by means of the sea pressure (related to the depth of the seawater intake section 508 from the surface of a body of water in which the subsea machine 304 is located) for removing the mixture from the chamber after separation has occurred the piston provided inside the housing and separating the housing into a top section and a bottom section; a step 908 of receiving and compressing the gas at the compressor section, the compressor section fluidly connected to the top section; and a step 910 of propelling the compressed gas towards an onshore facilities.

The method may also include one or more of the following steps: receiving the mixture from the undersea well at a first intake, the first intake being connected to the top section and being disposed near a top end of the chamber; receiving a seawater at a second intake, the second intake being connected to the bottom section and being disposed near a bottom end of the chamber; passing a gas through a first extraction exit which connects to the top section of the chamber and the compressor section, the first extraction exit being disposed through the top end of the chamber; exiting a liquid from the chamber via a second extraction exit, the second extraction exit being disposed below the first extraction exit and being connected to the top section; exiting a mud from the chamber via a third extraction exit, the third extraction exit being disposed below the second extraction exit and being connected to the top section; exiting the seawater from the chamber via a fourth extraction exit, the fourth extraction exit being disposed below the third extraction exit and being connected to the bottom section near the bottom end of the chamber; generating, by a sound vibration module, sound, vibration or some combination of sound and vibration to reduce the time required for separation of the received mixture to occur; extracting seawater from the chamber with a pump; extracting the gas from the chamber after separation has occurred by the compressor section; extracting liquid from the chamber after separation as occurred by a liquid extraction pump; and extracting mud, other solids, and other semi-solids from the chamber after separation has occurred by a mud extraction pump.

According to exemplary embodiment, a subsea machine for separating a mixture received from a seabed well includes a chamber configured to receive the mixture from the seabed well and sea water and to eject the mixture by using a pressure of the sea water inside the chamber. The machine may also include a piston provided inside the chamber and separating the chamber into a first section and a second section the piston being configured to move in a first direction along an axis by means of the pressure applied by the mixture received from the seabed well in order to create more space in the top section for receiving the mixture from the seabed well and to move in a second opposite direction along the axis by means of the sea-water pressure in order to eject the mixture when the mixture is separated into a liquid portion, a gas portion and a mud portion respectively from the first section through respective outlets; a first inlet with a first inlet valve means in the first section through which the mixture enters inside the first section at the pressure of the well; a first outlet with a first outlet valve means in the first section through which the mixture exits from the first section; a second inlet with a second inlet valve means in the second section through which the sea-water enters; and a second outlet with a second outlet valve means in the second section through which the water exits. The machine may include a first outlet port may be configured to connect the first section of the chamber and the compressor section and to allow passage of a gas portion of the mixture, a second outlet port configured to exit a liquid portion of the mixture from the first section of the chamber, the second extraction exit being disposed below the first extraction exit; and a third outlet port configured to exit a mud portion of the mixture from the first section of the chamber, the third extraction exit being disposed below the second extraction exit. The piston may move in order to provide a first separation between the liquid, the gas and the mud portions of the mixture inside the first section. The machine may have the piston moves in order to provide a first compression of the mixture inside the first section. The mixture received from the seabed well may includes two or more different substances which are physically mixed together.

The above-described exemplary embodiments are intended to be illustrative in all respects, rather than restrictive, of the present invention. Thus the present invention is capable of many variations in detailed implementation that can be derived from the description contained herein by a person skilled in the art. All such variations and modifications are considered to be within the scope and spirit of the present invention as defined by the following claims. No element, act, or instruction used in the description of the present application should be construed as critical or essential to the invention unless explicitly described as such. Also, as used herein, the article "a" is intended to include one or more items.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other example are intended to be within the scope of the claims if they have structural elements that do not differ from the literal language of the claims, or if they include equivalent structural elements within the literal languages of the claims.

What is claimed is:

1. A subsea machine for separating a mixture received from a seabed well, the subsea machine comprising:

a chamber configured to receive and separate by gravity the mixture received from the seabed well, the chamber comprising:

a housing configured to contain the mixture received from the undersea well during separation, and a piston provided inside the housing and separating the housing into a top section and a bottom section, the piston being configured to move in a first direction along an axis to create more space in the top section for receiving the mixture from the seabed well and to move in a second opposite direction along the axis for removing the mixture from the top section after separation has occurred;

a compressor section fluidly connected to the top section, the compressor section being configured to receive, compress and propel the gas towards an onshore facilities; and a sound vibration module configured to selectively use sound, vibration or some combination of sound and vibration to reduce the time required for separation of the received mixture to occur.

2. The subsea machine of claim 1, further comprising:

a first intake connected to the top section and configured to receive the mixture from the seabed well, the first intake being disposed near a top end of the chamber; and a second intake connected to the bottom section and configured to receive seawater, the second intake being disposed near a bottom end of the chamber.

3. The subsea machine of claim 1, further comprising:

a first extraction exit configured to connect the top section of the chamber and the compressor section and to allow passage of a gas, the first extraction exit being disposed through the top end of the chamber;

a second extraction exit connected to the top section and configured to exit liquid from the chamber, the second extraction exit being disposed below the first extraction exit;

a third extraction exit connected to the top section and configured to exit mud from the chamber, the third extraction exit being disposed below the second extraction exit; and a fourth extraction exit connected to the bottom section and configured to exit seawater from the chamber, the fourth extraction exit being disposed below the third extraction exit near the bottom end of the chamber.

4. The subsea machine of claim 1, further comprising:

a pump configured to extract seawater from the chamber.

5. The subsea machine of claim 1, wherein the chamber has a height substantially in a range of 1.0-10.0 meters.

6. The subsea machine of claim 1, wherein the compressor section extracts the gas from the chamber after separation has occurred.

7. The subsea machine of claim 1, further comprising:

a liquid extraction pump configured to extract liquid from the chamber after separation has occurred; and a mud extraction pump configured to extract mud, other solids, and other semi-solids from the chamber after separation has occurred.

8. A method for separating a mixture received from a seabed well in a subsea machine, the method comprising:

receiving and separating the mixture received from the seabed well in a chamber;

using a sound vibration module configured to selectively use sound, vibration or some combination of sound and vibration to reduce the time required for separation of the received mixture to occur;

containing the mixture received from the seabed well during separation in a housing;

moving a piston in a first direction along an axis to create more space in the chamber for receiving the mixture and moving the piston in a second opposite direction along the axis for removing the mixture from the chamber after separation has occurred, the piston provided inside the housing and separating the housing into a top section and a bottom section;

receiving and compressing the gas at a compressor section, the compressor section fluidly connected to the top section; and propelling the compressed gas towards an onshore facilities.

9. A subsea machine for separating a mixture received from a seabed well, the subsea machine comprising:

a chamber configured to receive the mixture from the seabed well and sea water and to eject the mixture by using a pressure of the sea water inside the chamber, the chamber having a first vertical section, a second vertical section and a bottom section, the bottom section being configured to receive and hold seawater, both the first vertical section and second vertical section having a mixture intake, an oil extraction outlet and a gas extraction outlet, the oil extraction outlet and gas extraction outlet of one vertical section being configured to open to allow the exit of gas and oil based on force exerted by well mixture entering the mixture intake of the other vertical section to the seawater in the bottom section, and a sound vibration module configured to selectively use sound, vibration or some combination of sound and vibration to reduce the time required for separation of the received mixture to occur.

10. The method of claim 8, further comprising receiving and separating the mixture received from the seabed well in the chamber comprises using a first intake connected to a top section of the housing, the first intake being disposed near a top end of the chamber and a second intake connected to a bottom section of the housing and configured to receive seawater the second intake being disposed near a bottom end of the chamber.

11. The method of claim 8, wherein removing the mixture from the chamber after separation has occurred further comprises using a first extraction exit configured to connect the top section of the chamber and the compressor section and to allow passage of a gas, the first extraction exit being disposed through the top end of the chamber;

a second extraction exit connected to the top section and configured to exit liquid from the chamber, the second extraction exit being disposed below the first extraction exit;

a third extraction exit connected to the top section and configured to exit and from the chamber, the third extraction exit being disposed below the second extraction exit; and a fourth extraction exit connected to the bottom section and configured to exit seawater from the chamber, the fourth extraction exit being disposed below the third extraction exit near the bottom end of the chamber.

12. The method of claim 8, wherein the chamber has a height substantially in a range of 1.0-10.0 meters.

13. The method of claim 8, wherein the compressor section extracts the gas from the chamber after separation has occurred.

14. The method of claim 8, further comprising:

extracting liquid from the chamber after separation has occurred using a liquid extraction pump; and extracting mud, other solids, and other semi-solids from the chamber after separation has occurred using a and extraction pump configured to extract mud.

* * * * *